United States Patent [19]

Murakami

[11] Patent Number: 4,520,237

[45] Date of Patent: May 28, 1985

[54] ELECTRODYNAMIC SPEAKER

[75] Inventor: Fumikazu Murakami, Tokyo, Japan

[73] Assignee: Kabushiki Kaisha Daini Seikosha, Tokyo, Japan

[21] Appl. No.: 421,799

[22] Filed: Sep. 23, 1982

[30] Foreign Application Priority Data

Sep. 25, 1981 [JP] Japan ..... 56-151765

[51] Int. Cl.[3] ..... H04R 9/04

[52] U.S. Cl. ..... 179/115.5 ES; 179/115.5 R; 179/117; 179/119 R

[58] Field of Search ..... 179/115.5 PC:115.5 VC, 179/115.5 R, 115.5 ES, 117, 119 R, 120

[56] References Cited

U.S. PATENT DOCUMENTS

| | | | |
|---|---|---|---|
| 3,133,162 | 5/1964 | Coen | 179/115.5 R |
| 3,138,864 | 6/1964 | Coen | 179/115.5 R |
| 3,430,007 | 2/1969 | Thielen | 179/115.5 R |
| 3,453,400 | 7/1969 | Coen | 179/115.5 R |
| 4,143,537 | 3/1979 | Ribatto | 179/115.5 R |
| 4,158,756 | 6/1979 | Keezer | 179/115.5 R |
| 4,376,233 | 3/1983 | Kamon et al. | 179/115.5 R |

FOREIGN PATENT DOCUMENTS

| | | | |
|---|---|---|---|
| 856614 | 7/1948 | Fed. Rep. of Germany | 179/115.5 R |
| 2803707 | 8/1979 | Fed. Rep. of Germany | 179/117 |
| 1489095 | 5/1966 | France | 179/115.5 PC |
| 2490439 | 3/1982 | France | 179/115.5 R |
| 58-153496 | 9/1983 | Japan | 179/115.5 R |

*Primary Examiner*—Gene Z. Rubinson
*Assistant Examiner*—Danita R. Byrd
*Attorney, Agent, or Firm*—Robert E. Burns; Emmanuel J. Lobato; Bruce L. Adams

[57] ABSTRACT

In an electrodynamic speaker comprising a vibrating plate, a voice coil secured to the vibrating plate, a magnetic circuit portion having a soft magnetic member and a magnet and having a magnetic gap, a frame for supporting the peripheral portion of the vibrating plate and the magnetic circuit portion, and a lead substrate. The voice coil is secured to the vibrating plate after the vibrating plate is secured to the frame and then the magnetic circuit portion is assembled on the frame. As a result of it, the lead terminal of the voice coil can be connected to the lead substrate through the notch portion of the frame in the same process as mounting the voice coil on the vibrating plate wherey the factor of variation in the magnetic gap dimension which affects the efficiency of the magnetic circuit is reduced.

13 Claims, 9 Drawing Figures

ELECTRODYNAMIC SPEAKER

BACKGROUND OF THE INVENTION

The present invention relates to an electrodynamic speaker, and more particularly to a miniature, thin and cost-saving electrodynamic speaker with excellent working property of fabrication and a highly efficient magnetic circuit.

FIG. 1 shows the structure of a conventional electrodynamic speaker. The speaker is fabricated in the following order in FIG. 1. A voice coil 5 is secured to a vibrating plate 1. Then a yoke 7, on which a magnet 8 and a pole piece 9 are mounted, is secured to a frame 2. The peripheral portion of the vibrating plate 1 is secured to the frame 2. A lead terminal 6 of the voice coil 5 is fixedly secured to a lead substrate 3 positioned on the lower surface of the frame 2 through a back hole 4 thereof. This structure has the following drawbacks:

(1) Since the voice coil 5 is secured on the thin and easily deformable vibrating plate 1, the voice coil cannot be positioned with accuracy.

(2) Non-uniformity of the clearance between the peripheral portion of the vibrating plate 1 and the frame 2 in the diametrical direction causes a variation in the voice coil position when the vibrating plate 1 is secured to the frame, whereby the voice coil 5 may sometimes be in contact with the pole 9 or the yoke 7.

(3) It takes time to lead the lead terminal 6 of the voice coil 5 through the back hole 4 to the lower surface of the frame 2.

(4) The fragile vibrating plate with the voice coil should be handled with great care since the lead terminal has not been attached.

As illustrated, the accurate positioning of the voice coil and the magnetic circuit is not ensured and the attachment of the voice coil terminal to the lead substrate takes time and is done during the course of securing the frame on which the magnetic circuit is mounted to the vibrating plate on which the voice coil is mounted.

The dimension of a magnetic gap and the position of the voice coil largely affect the efficiency and distortion of the electrodynamic speaker, and thus a speaker with high quality can not be realized without improving these aspects. For cost reduction, on the other hand, the fabrication process, such as securing of the voice coil, attachment of the lead terminal, and regulation of the magnetic gap by use of a jig for inserting the voice coil therein, should be improved.

To miniaturize a speaker, a vibrating member should be thinly made for reproducing a low sound in view of the reproduction frequency zone. Since miniature speakers are mostly used for portable devices, most vibrating plates are formed of a humidity-resistant polyester seat material by thermal pressure molding, as shown in FIG. 1. The accuracy of dimension of the vibrating plate is unstable as the vibrating plate is thin and subjected to the bending work, and the portion serving as a side in mounting the coil is hard to find. Further, the 8Ω resistance value, equivalent to the conventional type, cannot be obtained by the miniature speaker unless the wire for the voice coil is thinly made. Accordingly, great care should be taken in shifting the process without securing the voice coil terminal and thus it is preferable to treat the voice coil terminal in the same process as mounting the voice coil.

Generally, the effective diameter of a vibrating plate of a speaker largely affects its efficiency, and thus the efficiency of a miniature speaker necessarily deteriorates. Since a miniature portable device, however, operates on a limited power source, it is necessary to have a highly efficient speaker for use in portable devices. In view of the foregoing, the efficiency of the magnetic circuit portion, especially the dimension around the magnetic gap, is a very important point.

FIG. 2 shows another conventional embodiment. The voice coil terminal 6 is led to the peripheral portion of the vibrating plate 1 from where the voice coil is mounted, and connected to the lead substrate 3 provided on the lower surface of the frame 2 through a notched recess 10 at the side surface of the frame 2. In this structure the lead terminal should be carefully secured to the lead substrate lest an abnormal sound should be produced by contact of the lead terminal with the vibrating plate. Therefore this embodiment is not suitable for a miniature and cost-saving speaker because the fabrication or assembly order is identical to that of FIG. 1, and thus the same drawbacks will occur.

SUMMARY OF THE INVENTION

The present invention aims to eliminate the above-noted drawbacks, and therefore an object of the invention is to improve the working property of fabrication and the efficiency of the speaker.

Another object of the invention is to provide an electrodynamic speaker comprising a vibrating plate, a voice coil secured to the vibrating plate, a magnetic circuit portion and lead substrates for securing the terminals of the voice coil, wherein the frame supports the vibrating plate at an upper end surface thereof and has a center hole which mates with the magnetic circuit portion and a notch portion in the peripheral direction. The terminals of the coil are secured to the lead substrate provided at the lower surface of the frame through the notch portion, and a step portion or a projection for holding the magnetic circuit portion is provided at both or one of the center hole of the frame and the peripheral portion of the magnetic circuit when the magnetic circuit is assembled from the lower surface of the frame to thereby fixedly secure the magnetic circuit portion to the frame.

PREFERRED EMBODIMENTS OF THE INVENTION

Figure 3:
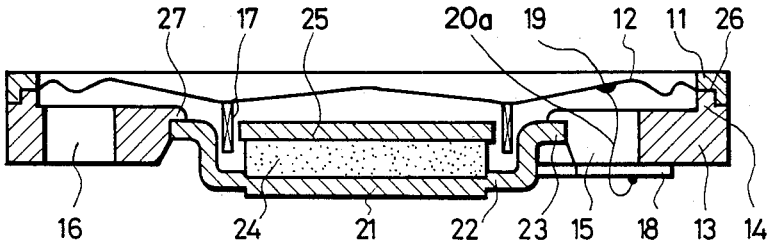
FIG. 3 shows a sectional view of an electrodynamic speaker according to the present invention.
Figure 4:
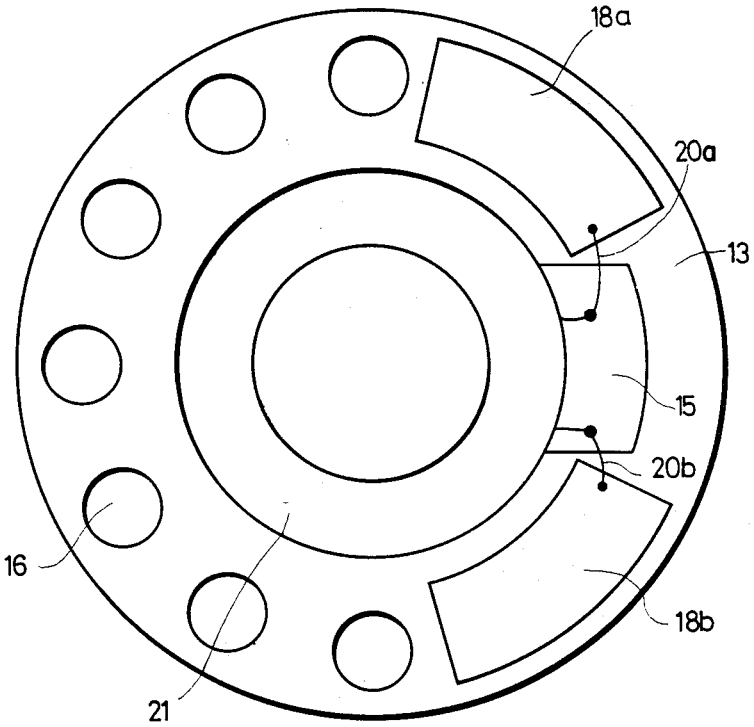
FIG. 4 shows a plan view of FIG. 3.

FIG. 3 shows a sectional view of a speaker according to the present invention and FIG. 4 is a plan view of the same. Reference numeral 11 denotes a guard frame provided with a step portion 26. 13 denotes a main frame provided with a ring-shaped projection 14 at the upper end surface to mate with the step portion 26 of the guard frame 11. The main frame 13 has a center hole with a notch portion 15 and a recess or step portion 27. The frame 13 has plural back holes 16, and lead substrates 18*a* and 18*b* are secured to the lower surface thereof. The frame 13 is molded by plastic injection molding. 12 denotes a vibrating plate molded into a desired shape by heating the polyester seat material. The peripheral portion of the vibrating plate 12 is sandwiched between the projection 14 of the frame 13 and the step portion 26 of the guard frame 11. A voice coil 17 is wound into a hollow cylinder shape, with adjacent wire coils being adhered to each other to keep the hollow cylinder shape, and the ring-shaped upper end of the voice coil 17 is adhered to the vibrating plate 12. The terminals 20*a*, 20*b* of the voice coil winding are led in the peripheral direction along the contour of the vibrating plate 12 from where the voice coil is mounted and secured to a securing portion 19 as shown and connected to the lead substrates 18*a* and 18*b* through the notch portion 15 of the main frame 13 from the securing portion 19. 21 denotes a dish-shaped yoke made of a soft magnetic material by a choking process and the yoke 21 is provided with a flat projecting portion 23 at the periphery and a step portion 22 at the bottom thereof. Element 25 denotes a disk-shaped pole piece pressed out of a soft magnetic plate. Element 24 denotes a disk-shaped permanent magnet made of samarium cobalt. The pole piece 25 is mounted on an upper surface of the magnet 24, and the lower end surface of the magnet 24 fixedly mates with the step portion 22 at the bottom of the yoke 21. A magnetic circuit assembly portion is formed by the yoke 21, the magnet 24 and the pole piece 25. A magnetic air gap is formed by the side surface of the pole piece 25 and the upstanding sidewell portion of the yoke 21. The peripheral flat projecting portion 23 of the yoke 21 fixedly mates with the recess or step portion 27 of the frame, whereby the frame is connected with the magnetic circuit portion.

Figure 5:
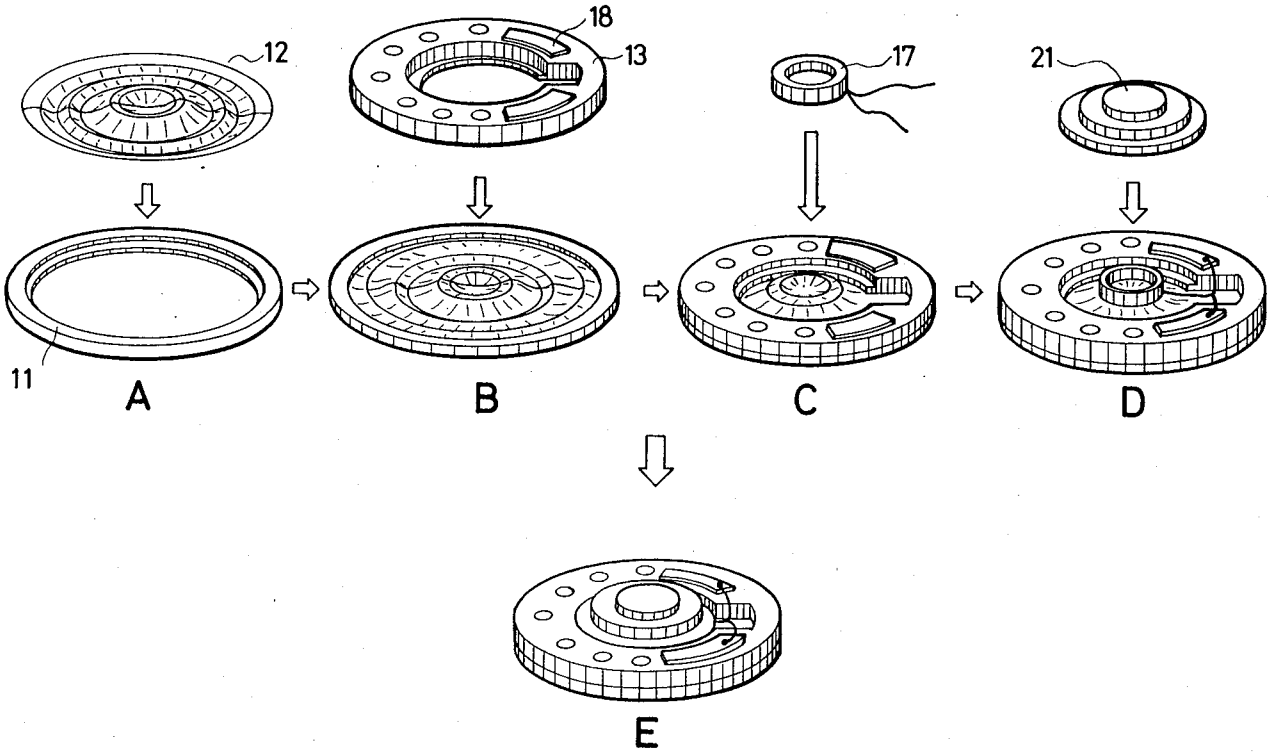
FIG. 5 shows a perspective view of the fabrication order of the speaker in FIG. 3.

FIG. 5 shows the order of fabrication of the speaker. The speaker is fabricated in the order of A→B→C→D→E as shown in FIG. 5. First, the vibration plate 12 is fabricated being guided by the step portion 26 of the guard frame 11, as shown by A. The main frame 13, on which the lead substrate 18 is mounted, is secured to the guard frame 11 to sandwich the vibrating plate 12 therebetween, as shown by B. The voice coil 17 is then adhered to the vibrating plate 12, as shown by C, being guided by a jig (not shown) provided at the step portion 27 of the frame. The yoke 21 with the pole piece 25 and the magnet 24 is secured to the recess or step portion 27 of the frame 13, as shown by D. Thus the speaker as shown by E is assembled or fabricated in the above order.

Figure 1:
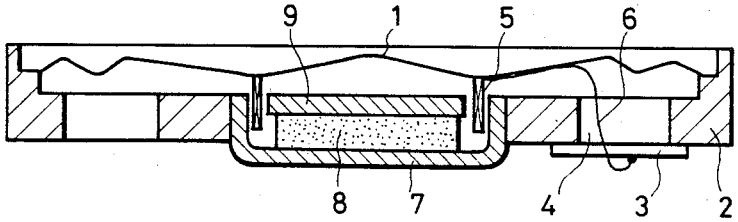
FIG. 1 PRIOR ART
FIG. 1 and FIG. 2 show conventional electrodynamic speakers.
Figure 2:
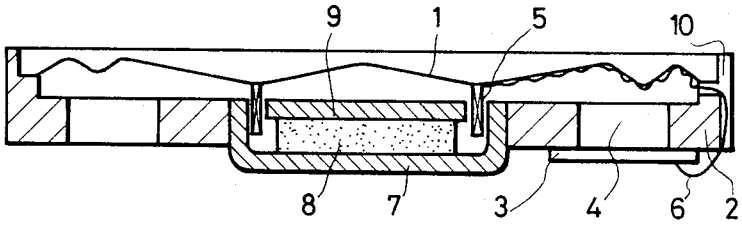
FIG. 2 PRIOR ART

The structure of the present invention is characterized in that the voice coil is secured after the vibrating plate 12 is secured to the frame 13, and then the magnetic circuit assembly portion is attached. The voice coil 17 is secured after the frame is integral with the vibrating plate as shown by C, and the coil terminals are connected to the lead substrate 18 in the same process as mounting the voice coil. Namely, the process of leading the terminals 20*a*, 20*b* to the lead substrates 18*a*, 18*b* through the notch portion 15 is easier than the treatment in FIGS. 1 and 2 since the magnetic circuit portion has not as yet been attached. Although the treatment of the voice coil is an extremely troublesome process, the coil terminals can be treated soon after the voice coil is fixedly secured to the firm frame according to the present invention, whereby the voice coil can be roughly treated in conveying it. On the contrary, great care has been required for the thin vibrating plate that has the voice coil whose terminals have not been treated in the conventional type structure.

Further, the efficiency of the speaker is improved in the present invention since the dimension of the magnetic air gap is reduced. Namely, both the voice coil and the magnetic circuit portion are mounted being guided by the step portion 27 of the frame 13, and thus the relative position of the voice coil and the magnetic circuit are decided with accuracy. The relative position of the voice coil and the magnetic circuit in the conventional type structure varies in mass production due to the following factors: variation in the position of the voice coil relative to the outer diameter of the vibrating plate; variation in the outer diameter of the vibrating plate; variation in the clearance between the diameter of the step portion of the vibrating plate and the outer diameter of the vibrating plate; and variation in the position of the magnetic circuit relative to the diameter of the step portion of the vibrating plate. Generally, the larger the dimension of the plastic parts, the more the variation range. Use of the outer diameter of the vibrating plate brings about the above mentioned variation factors, and the amount of variation is large. According to the present invention, however, the voice coil is mounted being guided by the firm frame. Further, the factors of variation comprise only the position on which the voice coil is mounted and the position on which the magnetic circuit is mounted relative to the diameter of the step portion 27 of the frame 13. The diameter of the step portion 27 of the frame 13 is also smaller. Thus the overall variation range can be minimized and the relative position of the voice coil and the magnetic circuit can be decided with accuracy.

The provision of the guard frame 11 and the step portion 26 enables the speaker to be fabricated from one direction as shown in FIG. 5, and thus the set time and conveying time for the next process can be shortened and the automation of fabrication can be easily realized. Further the peripheral portion of the vibrating plate is surely fixed by the guard frame.

Figure 6:
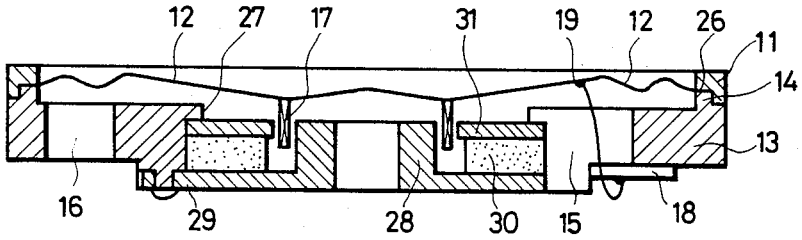
FIG. 6 shows another embodiment of the present invention.
Figure 7:
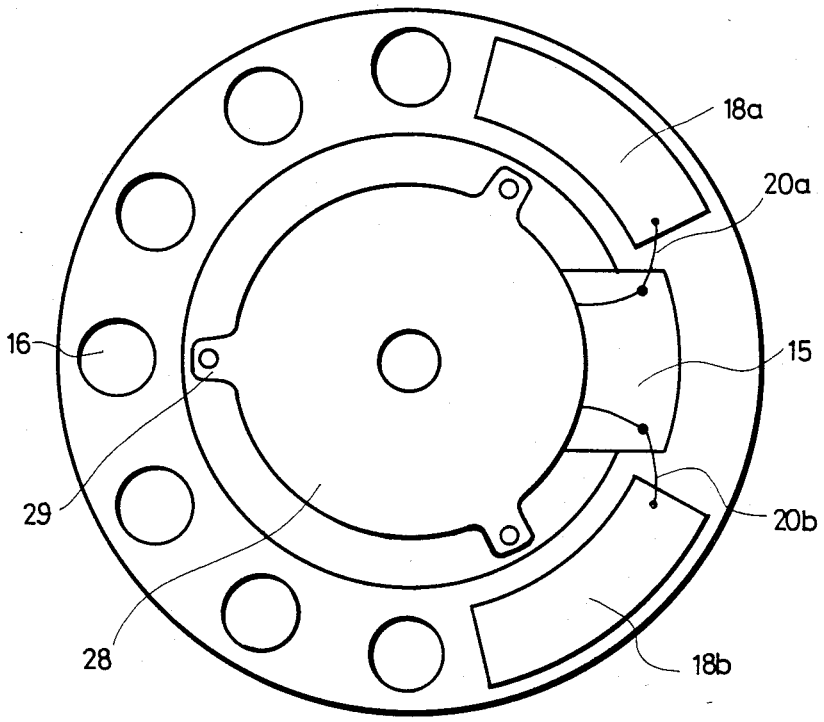
FIG. 7 shows a plan view of FIG. 6.

FIG. 6 shows another embodiment of the present invention, in which the magnet is provided outside or exteriorly of the coil. FIG. 7 shows a plan view of FIG. 6. Numeral 28 denotes a lower yoke plate made of soft magnetic material provided with a center hole at the center and a projection at the peripheral portion. 30 denotes a ring-shaped magnet and 31 denotes a pole piece comprised of a ring-shaped upper plate made of soft magnetic material. A magnetic circuit portion is made up of the yoke 28, the magnet 30 and the pole piece 31. The magnetic circuit portion is fabricated or assembled from the lower surface of the frame 13, and mates with the upper frame 31 at the step portion 27 of the frame 13, and is connected with the frame at the projection 29 of the lower plate. The remaining structure and order of fabrication of the FIG. 6 embodiment is identical to the embodiment in FIG. 3. Since the magnet 30 is arranged at the outer periphery in the outer magnet type magnetic circuit of this structure, the diameter of the voice coil 17 is smaller in comparison with the embodiment in FIG. 3, and the difference in diameter between the voice coil and the step portion 27 of the frame 13 is larger. Consequently the voice coil can be easily mounted on the vibrating plate. Moreover, since the voice coil 17 is mounted being guided by the inner diameter of the step portion 27 of the frame 13, and since the outer periphery of the upper plate 31 mates with the diameter of the step portion 27, the magnetic gap required to insert the voice coil 17 can be minimized.

Figure 8:
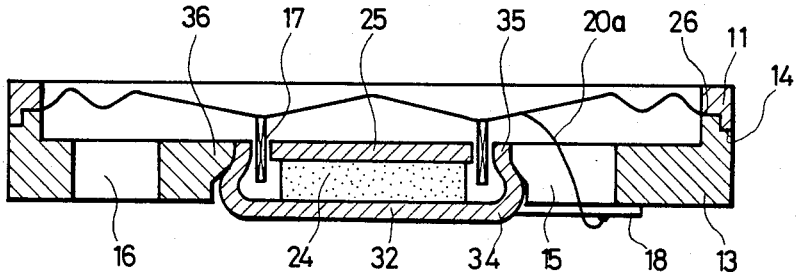
FIG. 8 shows another embodiment of the present invention.
Figure 9:
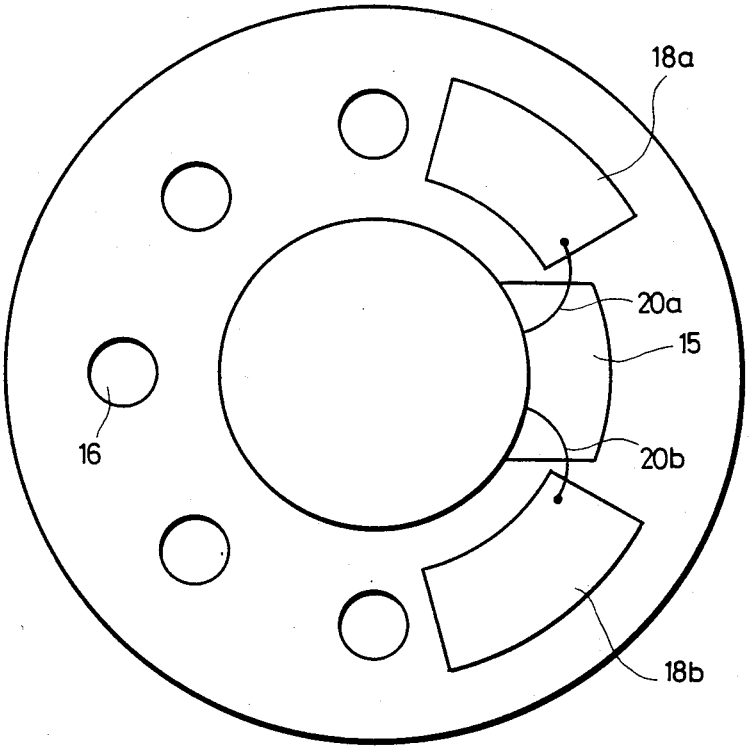
FIG. 9 shows a plan view of FIG. 8.

FIG. 8 is another embodiment of the present invention having an improved shape of the yoke, and in which the magnet is provided inside or interiorly of the coil. FIG. 9 is a plan view of the same. In this embodiment a yoke 32 having a bowl-shape is provided with a rim portion 35 and an expanded portion 34. The magnet 24 on which the pole piece 25 is mounted is secured to the bottom of the yoke 32, and the outer periphery of the rim portion 35 mates with the inner periphery of the center hole of the frame 13, and a step portion 36 of the frame supports the expanded portion 34 to thereby secure the yoke. The shape of the rim portion 35 is advantageous as the magnetic circuit and the magnetic flux of the magnetic gap is made uniform by the expanded portion 34. In a magnetic circuit with thin magnet, especially, this shape is extremely effective to increase the magnetic flux in the magnetic gap.

As illustrated, according to the present invention, the voice coil can be secured to the vibrating plate after the frame is secured thereto, and the magnetic circuit can be mounted lastly. Accordingly, the lead terminals of the voice coil can be connected to the lead substrates through the notch portion in the same process as mounting the voice coil on the vibrating plate, whereby the working property of the miniature speaker is largely improved. The factor of variation in the magnetic gap dimension which affects the efficiency of the magnetic circuit is also reduced, whereby a highly efficient speaker is realized.

What is claimed is:

1. An electrodynamic speaker comprising: a vibrating plate; a voice coil having a terminal and being secured to said vibrating plate; a magnetic circuit portion comprising a yoke, a pole piece and a magnet and being arranged so as to define a magnetic gap between the pole piece and the yoke; a main frame having a ring-shaped projection for supporting the peripheral portion of said vibrating plate; a ring-shaped guard frame having a step portion and being disposed atop the main frame to sandwich the peripheral portion of the vibrating plate between the step portion of the guard frame and the projection of the main frame; a lead substrate for securing said terminal of said voice coil; said main frame having a center hole which mates with the magnetic circuit portion and a notch portion adjacent to and opening into the center hole; the terminal of said voice coil extending through the notch portion and being secured to the lead substrate at the lower surface of the main frame; and means disposed at the periphery of the center hole of the main frame coacting with means disposed at the peripheral portion of the magnetic circuit portion for mounting the magnetic circuit portion on the lower surface of the main frame to thereby fixedly secure the magnetic circuit portion to the main frame.

2. An electrodynamic speaker as claimed in claim 1, wherein the yoke has a dish-shape having a bottom and a peripheral flat portion, the magnet on which the pole piece is mounted is secured to the bottom of the yoke, and the peripheral flat portion mates with a step portion of the main frame provided at the center hole.

3. An electrodynamic speaker as claimed in claim 2, wherein the yoke bottom has a step portion dimensioned to receive and hold the magnet.

4. An electrodynamic speaker as claimed in claim 1, wherein the pole piece comprises a ring-shaped upper plate, the magnet comprises a ring-shaped magnet and the yoke has a projection at the periphery of the center hole, the magnet and the upper plate being mounted on the yoke with the upper plate being held by a step portion of the main frame and the projection of the yoke mating with the frame.

5. An electrodynamic speaker as claimed in claim 1, wherein the yoke has a bowl-shape having an outwardly curved sidewall portion and a rim portion, the magnet on which the pole piece is mounted is secured to the bottom of the yoke, and the outer periphery of the yoke rim portion mates with a step portion of the main frame provided at the center hole of the main frame.

6. An electrodynamic speaker comprising: a main frame having an upper end and a lower end and having a ring-shaped projection projecting upwardly from the upper end; a guard frame having a ring-shaped step portion engaged with the ring-shaped projection; a vibratable plate having a peripheral portion sandwiched between and held by the engaged ring-shaped projection and step portion thereby supporting the vibratable plate for vibrational movement; the main frame having a center hole extending therethrough, and a radial notch extending completely through the main frame and opening at the center hole and extending radially outwardly thereof; a voice coil secured to the lower side of the vibratable plate and depending into the main frame center hole, the voice coil having a pair of coil terminals extending through the main frame notch so that the coil terminal ends project beyond the main frame lower end; a magnetic circuit assembly comprised of a magnet interposed between a pole piece and a yoke and being configured to define an air gap between opposed portions of the pole piece and yoke; and means mounting the magnetic circuit assembly within the main frame center hole such that the voice coil extends into the air gap defined by opposed portions of the pole piece and yoke.

7. An electrodynamic speaker according to claim 6; wherein the yoke has a flat bottom portion and an upstanding sidewall portion surrounding the bottom portion and extending upwardly thereof in spaced relation from the pole piece to define therewith the air gap.

8. An electrodynamic speaker according to claim 7; wherein the upstanding sidewall portion of the yoke terminates in a radially outwardly extending projection; and the means mounting the magnetic circuit assembly comprises the yoke projection, and means defining a recess in the main frame in the region of the center hole, the yoke projection being secured in the main frame recess thereby mounting the magnetic circuit assembly within the main frame center hole.

9. An electrodynamic speaker according to claim 8; wherein the yoke bottom portion has a recessed portion dimensioned to mate with the magnet thereby enabling precise positioning of the magnet relative to the yoke.

10. An electrodynamic speaker according to claim 7; wherein the yoke bottom portion has a recessed portion dimensioned to mate with the magnet thereby enabling precise positioning of the magnet relative to the yoke.

11. An electrodynamic speaker according to claim 7; wherein the upstanding sidewall portion of the yoke has an outwardly curved portion connected at its lower end to the yoke bottom portion and terminating at its upper end in an upwardly extending rim portion; and the means mounting the magnetic circuit assembly comprises the yoke curved portion, and means defining a radially inwardly extending projection projecting inwardly of the main frame center hole, the yoke curved portion being secured to the main frame inwardly extending projection thereby mounting the magnetic circuit assembly within the main frame center hole.

12. An electrodynamic speaker according to claim 11; wherein the yoke upwardly extending rim portion is disposed in spaced relation from the pole piece to define therewith the air gap.

13. An electrodynamic speaker according to claim 6; wherein the yoke has an upwardly extending center projection extending interiorly of the voice coil, and the magnet and pole piece have a ring shape and are disposed on the yoke in spaced relation from the yoke center projection such that the air gap is defined between the yoke center projection and the ring-shaped pole piece.

* * * * *